US008661608B2

(12) United States Patent
Knopow et al.

(10) Patent No.: US 8,661,608 B2
(45) Date of Patent: Mar. 4, 2014

(54) HANDHELD PORTABLE DEVICES FOR TOUCHLESS PARTICULATE MATTER REMOVAL

(75) Inventors: Jeremy F. Knopow, Burlington, WI (US); Steven Merrill Harrington, Cardiff, CA (US); Andrew L. Banka, Ann Arbor, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 713 days.

(21) Appl. No.: 12/170,203

(22) Filed: Jul. 9, 2008

(65) Prior Publication Data

US 2009/0044372 A1 Feb. 19, 2009

Related U.S. Application Data

(60) Provisional application No. 60/948,676, filed on Jul. 9, 2007.

(51) Int. Cl.
*A47L 5/24* (2006.01)
*A47L 5/14* (2006.01)

(52) U.S. Cl.
USPC ..... 15/344; 15/345

(58) Field of Classification Search
USPC ..... 15/344, 345, 329
See application file for complete search history.

(56) References Cited

U.S. PATENT DOCUMENTS 868,901 A * 10/1907 Williams ..... 15/345
2,864,119 A * 12/1958 Crise ..... 15/404
3,328,827 A * 7/1967 Lake et al. ..... 15/344
3,678,534 A * 7/1972 Hilbig ..... 15/345
4,282,626 A * 8/1981 Schneider ..... 15/320
4,333,205 A * 6/1982 Woodward et al. ..... 15/345
4,629,128 A 12/1986 Lawrence
4,945,604 A 8/1990 Miner et al.
5,184,372 A 2/1993 Mache
5,187,635 A 2/1993 Yehl
5,279,076 A 1/1994 Healy et al.
5,457,847 A 10/1995 Uzawa et al.
5,477,585 A 12/1995 Hentzschel et al.

(Continued)

FOREIGN PATENT DOCUMENTS

EP 0640411 A 3/1995
GB 1211930 11/1970

(Continued)

OTHER PUBLICATIONS

PCT/US2008/069531 International Search Report and Written Opinion dated Nov. 5, 2008.

*Primary Examiner* — Bryan R Muller

(57) ABSTRACT

Handheld portable devices for dislodging and capturing particulate matter that has accumulated on various surfaces or structures are provided. The devices create opposing airflows that can intimately interface with each other during use. A vacuum airflow is drawn into the device, defining a vacuum affected zone upon the surface being cleaned. A high pressure airflow is emitted that penetrates through or passes adjacent to the opposing vacuum airflow and contacts the surface being cleaned, dislodging particulate matter therefrom. The high pressure airflow can be emitted from multiple nozzles as a series of airflow bursts that discretely contact the surface being cleaned. The configuration of each nozzle, as well as the overall arrangement and positions of all the nozzles together, are selected to impart the desired particulate matter dislodging characteristics to the device.

16 Claims, 11 Drawing Sheets

(56) References Cited

U.S. PATENT DOCUMENTS

| | | | | |
|---|---|---|---|---|
| 5,485,651 | A * | 1/1996 | Payeur | 15/321 |
| 5,577,294 | A | 11/1996 | Pollock | |
| 5,884,360 | A | 3/1999 | Palffy | |
| 6,123,618 | A | 9/2000 | Day | |
| 6,141,823 | A | 11/2000 | Fujiwara et al. | |
| 6,141,824 | A | 11/2000 | Fujiwara et al. | |
| 6,148,831 | A | 11/2000 | Lindstrom et al. | |
| 6,151,748 | A | 11/2000 | Earhart, Jr. et al. | |
| 6,378,163 | B1 * | 4/2002 | Moll et al. | 15/322 |
| 6,719,830 | B2 | 4/2004 | Illingworth et al. | |
| 6,773,334 | B1 | 8/2004 | Mallison | |
| 6,782,583 | B2 | 8/2004 | Oh | |
| 7,018,438 | B2 | 3/2006 | Duggan | |
| 7,086,119 | B2 | 8/2006 | Go et al. | |
| 7,111,797 | B2 * | 9/2006 | Bezama et al. | 15/345 |
| 7,112,247 | B2 | 9/2006 | Stelcher et al. | |
| 7,357,823 | B1 | 4/2008 | Streciwilk | |
| 2003/0097727 | A1 | 5/2003 | Keller | |
| 2004/0098825 | A1 * | 5/2004 | Swift et al. | 15/345 |
| 2005/0155176 | A1 | 7/2005 | Chen | |
| 2006/0070208 | A1 * | 4/2006 | Follegot et al. | 15/344 |
| 2006/0213025 | A1 | 9/2006 | Sawalski | |
| 2006/0288495 | A1 | 12/2006 | Sawalski et al. | |
| 2006/0288516 | A1 | 12/2006 | Sawalski | |
| 2008/0141483 | A1 | 6/2008 | Pearlstein | |
| 2008/0155769 | A1 | 7/2008 | Schonewille et al. | |
| 2008/0178410 | A1 | 7/2008 | Salmon | |
| 2008/0178416 | A1 | 7/2008 | Conrad | |
| 2008/0184515 | A1 | 8/2008 | Chapman et al. | |
| 2008/0184518 | A1 | 8/2008 | Taylor et al. | |
| 2008/0189069 | A1 | 8/2008 | Beck | |
| 2008/0201899 | A1 | 8/2008 | Voorhorst et al. | |

FOREIGN PATENT DOCUMENTS

| | | | |
|---|---|---|---|
| GB | 2338404 | A | 12/1999 |
| GB | 2345839 | A | 7/2000 |
| JP | 2008-119266 | | 5/2008 |
| WO | 0025653 | A | 5/2000 |
| WO | 2008048552 | A | 4/2008 |
| WO | WO2008/092723 | | 8/2008 |

* cited by examiner

HANDHELD PORTABLE DEVICES FOR TOUCHLESS PARTICULATE MATTER REMOVAL

CROSS-REFERENCE TO RELATED APPLICATIONS

This utility patent application claims the benefit of and priority to U.S. provisional application 60/948,676, filed Jul. 9, 2007, which is herein expressly incorporated by reference in its entirety, for all purposes.

BACKGROUND OF THE INVENTION

1. Field of the Invention

The present invention relates to devices for removing dust and debris from surfaces without contacting those surfaces and, more specifically, to handheld portable devices for dislodging and capturing dust and debris which have accumulated on various surfaces.

2. Discussion of the Related Art

In many household environments, a number of airborne particulates and debris, e.g., allergens, dust, and/or other airborne matter, are present which can create respiratory problems for individuals living within the home. Some such airborne particulates can accumulate on various readily viewable surfaces within the home, which can be aesthetically unpleasant.

To manage, control, or otherwise influence the airborne travel or accumulation of airborne particles, numerous known devices and procedures are utilized. As a first example, a number of different air cleaning and purification devices have been developed which draw the air from the interior environments of the home through the device in order to filter and remove allergens, dust, or other airborne particulates from the airflow passing through the device. However, such devices are unable to completely eliminate settling and accumulation of dust, allergens, debris, and other airborne particulates. Accordingly, such devices have not eliminated the need for various household upkeep duties such as dusting.

Removing dust from certain surfaces can prove especially tedious or otherwise difficult. For example, removing dust from areas with numerous small movable items, e.g., various collectibles, memorabilia, or others typically requires removing the items from the underlying support surface.

Furthermore, removing dust or other debris from the small items themselves, likewise, can prove rather tedious. Typically, the small items are removed from the underlying support surface and physically manipulated to expose the various outer surfaces of the small items to the dust removal device, whether it is a duster or otherwise. Accordingly, typical household dusting tasks can take a considerable amount of time to perform adequately.

Other devices, such as vacuum cleaners and their attachments, have been introduced to reduce the relative time required to perform dust removal tasks. However, the vast majority of these devices are relatively large and bulky. Accordingly, users must move such devices, e.g. vacuum cleaners, about the household while dusting because users are tethered, to the devices, e.g. by way of a vacuum hose.

Yet other devices, such as various handheld vacuum devices, have also been introduced to simplify some household tasks. Such devices tend to be more useful for typical vacuum cleaning functions than for dust removal. The reason is that typical handheld vacuum devices are unable to draw enough vacuum pressure to dislodge dust and debris which might be stubbornly stuck to the surface being cleaned, especially without touching the surface. In other words, the vacuum pressure generated by handheld vacuums is typically not strong enough to remove dust from, e.g., collectables or furniture with fine finishes. Since users of handheld vacuums often touch the surface they are cleaning, such as car upholstery or floors, they are reluctant to use such devices in non-contact manners. Handheld vacuum devices typically have a narrow transversely extending slot as their inlets, rendering them ill-suited for use with conventional side-to-side dusting strokes. In addition, such devices tend to be somewhat heavy and some are unacceptably loud, whereby extended periods of use can prove frustrating and/or fatiguing for the user.

Therefore, it is desirable to develop a relatively small, handheld, and portable device, which is capable of both dislodging and capturing accumulated dust and debris from various surfaces, especially in a non-contact or touchless manner in some instances.

SUMMARY AND OBJECTS OF THE INVENTION

Consistent with the foregoing, and in accordance with the invention as embodied and broadly described herein, handheld portable devices for touchless particulate matter removal are disclosed in suitable detail to enable one of ordinary skill in the art to make and use the invention.

According to a first embodiment of the present invention, a device is presented for dislodging and capturing particulate matter that has accumulated on various surfaces or structures. Low and high pressures systems of the device create opposing airflows that can intimately interface with each other during use. From the low pressure system, a vacuum airflow is drawn into the device, defining a vacuum affected zone upon the surface being cleaned. It is noted that the vacuum airflow not only affects such surface but also acts upon a three-dimensional air space defined generally between the device and the surface being cleaned, e.g., removing airborne particulates therefrom. From the high pressure system, a high pressure airflow is emitted that penetrates through the opposing vacuum airflow and contacts the surface being cleaned, dislodging particulate matter therefrom. Optionally, the high pressure airflow does not penetrate the vacuum airflow but rather flows closely adjacent thereto or even intimately interfacing therewith, preferably in substantially opposing directions. The high pressure airflow can be emitted from multiple nozzles as a series of airflow bursts that discretely contact the surface being cleaned. The (i) configuration of each nozzle, (ii) overall arrangement and position(s) of all the nozzles together, (iii) particular firing or discharge sequence of the multiple nozzles, and (iv) duration and power or amplitude of each high pressure airflow burst, are selected to impart the desired particulate matter dislodging characteristics to the device. Additionally, outlets and/or inlets of the low pressure system are preferably sized and configured to optimize capturing performance of particulate matter.

In another embodiment, the device includes a handle and a nose segment extending away from the handle. A vacuum airflow enters nose segment and defines a vacuum affected zone on the surface being cleaned. A high pressure airflow exits the nose segment and penetrates through or flows adjacent to the vacuum airflow, contacting the surface to be cleaned. In this configuration, the high pressure airflow dislodges at least some of the particulate matter from the surface to be cleaned, which is then captured by the vacuum airflow. In this regard, the device can perform non-contact particulate matter removal from the surface being cleaned.

In some embodiments, the high pressure airflow is emitted from a nozzle at a supersonic velocity.

In another embodiment, the high pressure airflow is emitted as a series of discrete pulses. The discrete pulses can be emitted from multiple high pressure nozzles that are spaced from each other, along a length dimension of the nose segment, or otherwise.

In yet another embodiment, the device weighs less than 5 pounds, and preferably less than about 2 pounds.

In some embodiments, the device includes at least one accessory for mechanically dislodging particulate matter from the surface being cleaned. Such accessory can be a squeegee, disposable and/or dust removal cloth, a brush, or other accessory.

In yet other embodiments, the device includes (i) at least one primary vacuum inlet port that defines a passage for the vacuum airflow entering the nose, and (ii) at least one auxiliary vacuum inlet port that is spaced or removed from the primary vacuum inlet port. Such auxiliary vacuum inlet can be used to collect relatively large debris such as, e.g., large crumbs. The vacuum inlet can be provided on a handle assembly, main body segment, or nose segment of the device. When provided on a nose segment, the auxiliary vacuum inlet can be utilized by, e.g., actuating a movable or removable portion, such as a cover or shroud, of the nose segment.

In another embodiment, a low pressure airflow is emitted from the nose segment. The low pressure airflow at least partially contains the vacuum airflow and/or the high pressure airflow and therefore also influences the vacuum affected zone on the surface to be cleaned. Preferably, a user of the device can control or vary the velocity of such low pressure airflow emitted from the nose segment, or stop and start the emission of the low pressure airflow from the nose segment, as desired.

In yet another embodiment, the low pressure emitted airflow includes a chemical cleaning agent and/or a scented substance.

In yet another embodiment, the device includes an auxiliary high pressure nozzle that allows a user to select a targeted high pressure airflow. The auxiliary high pressure nozzle does not have to penetrate through the vacuum airflow, but rather can flow from an end of the nose segment, facilitating the user's ability to aim the auxiliary high pressure airflow, e.g., pulses. This can prove particularly beneficial when removing particulate matter that is upon a surface which is perpendicular to a plane defined by the primary high pressure nozzles, or particulate matter that is confined in spaces that restrict the user's ability to suitably align the primary high pressure nozzles for removal.

In some embodiments, the device has visual indicators that show the locations of the high pressure nozzles. For example, visual indicators are provided on an upper surface or elsewhere on the nose segment or body of the device. The visual indicators can be written, printed, or other indicia such as overmolding protrusions or depressions in an upper surface of the nose segment.

In another embodiment, the visual indicator is light emitted from the nose by, e.g., a light emitting diode (LED) or other suitable source of illumination.

In another embodiment, the invention includes a method of touchless particulate matter removal using a handheld portable device. During use, a vacuum airflow is drawn into the device away from a surface being cleaned that has accumulated particulate matter thereon. A high pressure airflow exits the device and flows through the vacuum airflow, dislodging at least some of the particulate matter from the surface being cleaned. At least some of the dislodged particulate matter becomes entrained into the vacuum airflow, whereby at least some of the particulate matter is removed from the surface and collected by the device without any surface contact.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
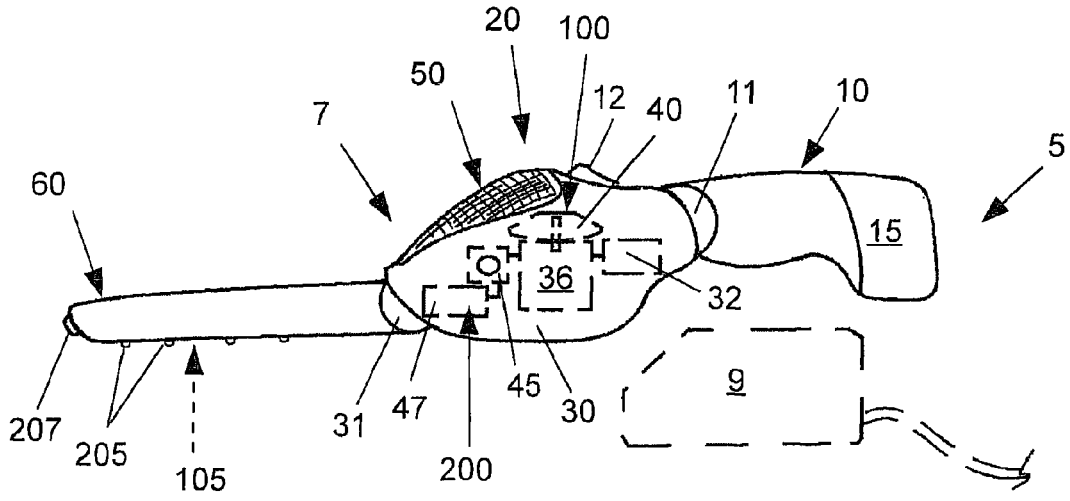
FIG. 1 is a partially schematic side elevation view of a first embodiment of a handheld portable device for touchless particulate matter removal of the present invention.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the words "connected", "attached", or terms similar thereto are used. However, they are not limited to direct connection but include connection through other elements where such connection is recognized by those skilled in the art.

DETAILED DESCRIPTION OF THE INVENTION

The present invention and the various features and advantageous details thereof are explained more fully with reference to the non-limiting embodiments described in detail in the following description.

A. System Overview

Figure 2:
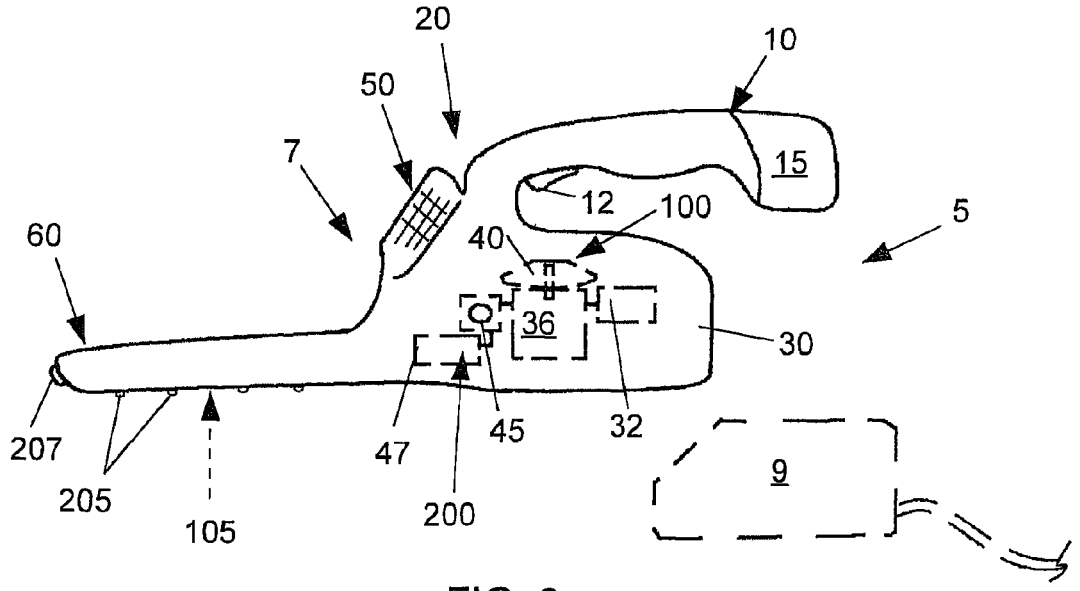
FIG. 2 is a partially schematic side elevation view of a second embodiment of a handheld portable device for touchless particulate matter removal of the present invention.

In a basic form, referring generally to FIGS. 1-2, the invention is a system 5 including a handheld portable device, e.g., device 7, for touchless or non-contact particulate matter removal. System 5 further includes a charging station 9 that can be configured as a docking station for holding the device 7 while it charges or recharges. Optionally, charging station 9 functions as a stand-alone battery charger which can, for example, maintain a charge in an extra battery for the device 7. In yet other embodiments, the charging station 9 is an integral component of device 7, whereby it serves as an AC to DC power converter and the device 7 assumes a "corded" configuration. In yet further embodiments, the device 7 is corded but is devoid of an AC to DC power converter, whereby any electronic devices therein are AC powered.

Referring still to FIGS. 1-2 and also to FIGS. 5-8, regardless of the particular configuration of charging station 9 and its interaction with device 7, the device 7 is configured for performing dust removal or other particulate matter removal type cleaning tasks, without ever touching the substrate of the surface being cleaned. To provide such touchless particulate matter removal, device 7 includes a low pressure system 100 and a high pressure system 200 which cooperate with each other to pneumatically remove particulate matter from the surface being cleaned. In typical embodiments, the low pressure system 100 uses one or more low pressure airflow components, for example, a high volume low-pressure airflow component, for capturing, retaining, and removing particulate matter. The airflow component of low pressure system 100 can include a negative pressure or vacuum airflow 110 (FIGS. 5-8) component, explained in greater detail elsewhere herein that draws the particulate matter into the device 7 where it is removed or captured by a filter assembly 50.

Referring now to FIGS. 1-2 and 7-8, in some embodiments, the low pressure system 100 also includes a positive pressure or outputted airflow component that can be used to at least partially laterally restrain the various airflows of the pneumatic particulate matter removal phenomenon of device 7, whereby a low pressure outputted airflow component serves as, e.g., an air curtain 140 (FIGS. 7-8) which is explained in greater detail elsewhere herein. The air curtain 140 can be defined by a high volume low-pressure airflow that is emitted from the device 7, which can at least partially pneumatically confine various other airflows of the device 7. Preferably, if an air curtain 140 is incorporated into the low pressure system 100, its flow rate is adjustable or can be turned off entirely, if desired.

In other words, referring again to FIGS. 1-2, the low pressure system 100 is configured to pull loosely settled or airborne particulate matter into the device 7, without requiring the device 7 to touch the surface or substrate being cleaned. However, it is noted that in many cleaning situations, for example, while performing various household dusting tasks, at least some particulate matter will be stuck, clung, lodged, or adhered to a surface to at least a modest extent. In these situations, the low pressure system 100 may experience difficulties in removing such particulate matter, whereby high pressure system 200 can then be fully appreciated.

Referring still to FIGS. 1-2, high pressure system 200 is configured to dislodge particulate matter that is stuck, clung, lodged, or adhered to a surface being cleaned by outputting a high pressure airflow from device 7. For example, the high pressure system 200 pneumatically overwhelms the attractive forces between the particulate matter and the substrate or surface, be it electrostatic, adhesive, mechanical, or otherwise. Preferably, high pressure system 200 does so by delivering high pressure airflow in discrete pulses. These pulses can be delivered at high velocities, for example, supersonic velocities. Correspondingly, the pneumatic airflow of high pressure system 200 loosens the particulate matter or renders it airborne, in either regard making the particulate matter more susceptible to the vacuum influences of low pressure system 100. Stated another way, the high pressure system 200 drives or dislodges the particulate matter and the low pressure system 100 removes and captures the particulate matter, preferably restraining the particulate matter in the filter assembly 50.

During most uses, the low and high pressure systems 100 and 200 are used concurrently. This allows the dislodging, removal, and capturing of particulate matter to occur in a generally simultaneous and continuous manner. However, as desired, a user can enable or disable certain airflow components of either or both of the low and high pressure systems 100 and 200. When only dislodging capabilities or relatively more dislodging capabilities are desired, the user can turn off the low pressure system 100, and/or direct the resources of device 7 to fewer than all components of the high pressure system 200, described in greater details elsewhere herein. Correspondingly, when only capturing capabilities or relatively more capturing capabilities are desired, the user can turn off the high pressure system 200, and/or direct the resources of device 7 to fewer than all components of the low pressure system 100, described in greater details elsewhere herein.

The versatility of the low and high pressure systems 100 and 200, along with the compact and easily portably configuration of system 5, make it suitable for numerous end use applications. Exemplary of such end use applications include, but are not limited to: household dust removal, other household particulate matter removal, automotive interior dust removal, other automotive interior particulate matter removal, automotive exterior dust removal, other automotive exterior particulate matter removal, commercial/industrial dust removal, other commercial/industrial particulate matter removal, and/or others. It is further noted that system 5 is not restricted to particulate matter removal from hard or other surfaces that are typically dusted with conventional dusting products, but also is useful for numerous other surfaces and substrates in which particulate matter redeposition occurs. For example, system 5 can be used for particulate matter removal or other types of soft-surface remediation for, e.g., upholstery, cloth and other lamp shades, draperies and valances, various collectables and/or other delicate or intricately cared-for items, as well as items with e.g., sharp protrusions or other physical characteristics that make them ill-suited for conventional cloth or other contact-style dust removal.

B. Detailed Description of Preferred Embodiments

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the examples discussed herein should not be construed as limiting the scope of the present invention.

1. Overview of Device Components and System Architecture

Referring now to FIGS. 1-9 and 12-13, device 7 includes a handle assembly 10 and a body assembly 20. Body assembly 20 includes a main body segment 30 and in some embodiments also includes a nose segment 60.

The handle assembly 10 provides the primary user interface for operating the device 7. A switch 12, which is preferably a conventional on/off trigger style switch, is provided on the handle assembly 10. When a user actuates the switch 12, the device 7 is energized. Upon releasing switch 12, the device 7 is de-energized. Handle assembly 10 can be generally hollow and house, for example, one or more batteries 15 therein. Optionally, handle assembly 10 incorporates charging station 9 therein, for example, as an AC to DC power converter, providing a corded configuration to device 7. Handle assembly 10 can be movably attached to other portions of device 7, e.g., body assembly 20, by way of a ball joint 11 (FIG. 1), optionally a hinge or other suitable joint or articulating connecting mechanism. Optionally, handle assembly 10 is fixedly attached to the body assembly 20, as seen in FIG. 2.

Referring still to FIGS. 1-9 and 12-13, body assembly 20 houses many or all of the moving and/or heat generating components of the low and high pressure systems 100 and 200, preferably within a generally unitary housing structure, e.g., main body segment 30. Exemplary of such moving and/or heat generating components of the low and high pressure systems 100 and 200 include a high speed or other DC, optionally AC, electric motor 32, a low pressure fan 40, a high pressure compressor 45, and a high pressure distribution valve 47.

Referring still to FIGS. 1-9 and 12-13, motor 32 either directly drives the low pressure fan 40, or, more preferably, drives an input shaft of a gearbox 36. For embodiments in which the motor 32 drives the gearbox 36 input shaft, the gearbox 36 can have output shafts, preferably three output shafts. In such embodiments, a first output shaft of gearbox 36 rotates the low pressure fan 40 and a second output shaft of gearbox 36 rotates, e.g., an input shaft of the high pressure compressor 45. A third output shaft operably connects motor 32 to the high pressure distribution valve 47. In other words, the gearbox 36 splits the power provided by motor 32, whereby a single motor 32 can drive both (i) the low pressure fan 40 of low pressure system 100, (ii) the high pressure compressor 45 of high pressure system 200, and (iii) the distribution valve 47 of high pressure system 200.

Regardless of the particular components housed in the main body segment 30, in some implementations of device 7, a nose segment 60 can be movably attached thereto. For example, ball joint 31 (FIG. 1), optionally a hinge or other suitable joint or articulating connecting mechanism, can connect the main body segment 30 to the nose segment 60. Optionally, nose segment 60 is fixedly attached to the main body segment 30, as seen in FIG. 2.

Referring again to FIGS. 1-9 and 12-13, for embodiments of device 7 that include a nose segment 60, the nose segment 60 can be an elongate, generally hollow, member that is sized and configured based at least in part on the configuration of cooperating components, as well as the intended end use of device 7. Preferably, the nose segment 60 is about 3 to 8 inches long, more preferably about 5 to 7 inches long, and defines rather narrow width and height dimensions, e.g., less than about 3 inches, optionally less than about 2 inches, and relatively small cross sectional area. As one example of a suitable cross sectional area, the nose can taper down from a relatively larger 2-inch by 2-inch area adjacent the main body segment 30 to a relatively smaller 1-inch by 1-inch area at its end portion. One embodiment of such a tapering configuration can be seen in the device 7 of FIG. 9. Regardless of the particular dimensions, the nose segment 60 is configured to provide a long swath or path allowing for quick dusting, yet is slender enough to easily traverse between or through closely arranged articles or spaces while reducing the likelihood of inadvertently bumping such articles.

Referring still to FIGS. 1-9 and 12-13, preferably nose segment 60 houses at least portions of various ducting structure(s) that direct the various airflow components into or out of the device. Exemplary airflow component directing structures include vacuum inlets 105 and high pressure nozzles 205 of the low and high pressure systems 100 and 200, respectively. By housing all of the primary inlets and outlets such as the vacuum inlets 105 and high pressure nozzles 205 within the nose segment 60, device 7 is able to generally concentrate both airflow inputs and outputs of the low and high pressure systems 100 and 200 onto a surface area, or affected zone, of the surface being cleaned.

In some embodiments, in addition to housing the primary vacuum inlets 105 and high pressure nozzles 205, nose segment 60 further houses an auxiliary vacuum inlet 107 and an auxiliary high pressure nozzle 207, displaced from the respective primary components.

Figure 3A:
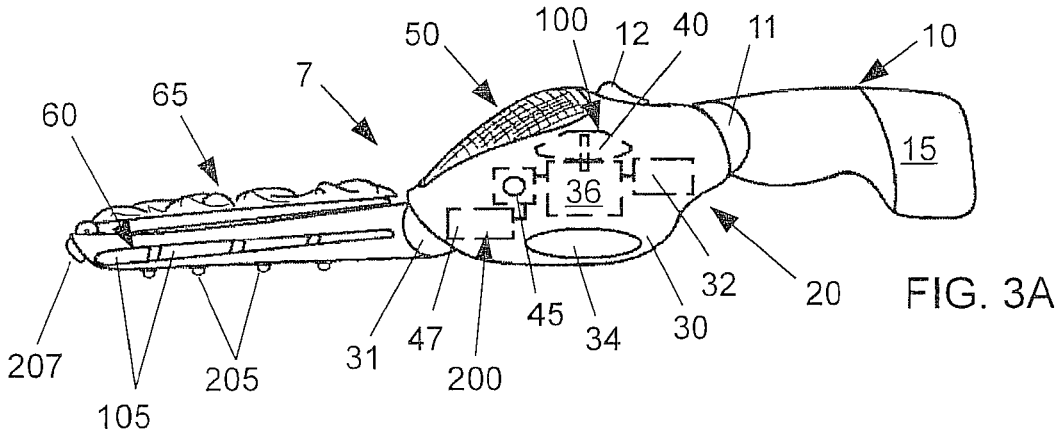
FIG. 3A is a partially schematic side elevation view of a third embodiment of a handheld portable device for touchless particulate matter removal of the present invention with a dusting cloth assembly in a folded down position.
Figure 3B:
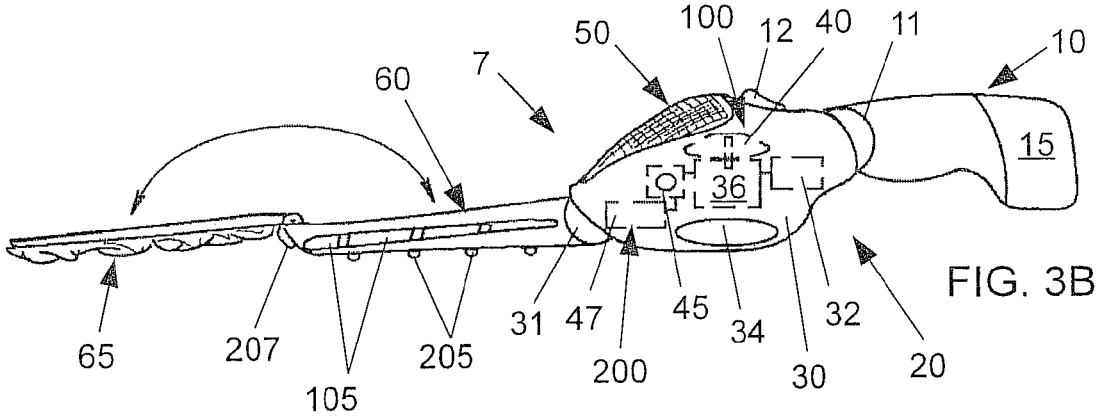
FIG. 3B is a partially schematic side elevation view of the handheld portable device of FIG. 3A with the dusting cloth assembly in an outwardly extended position.
Figure 3C:
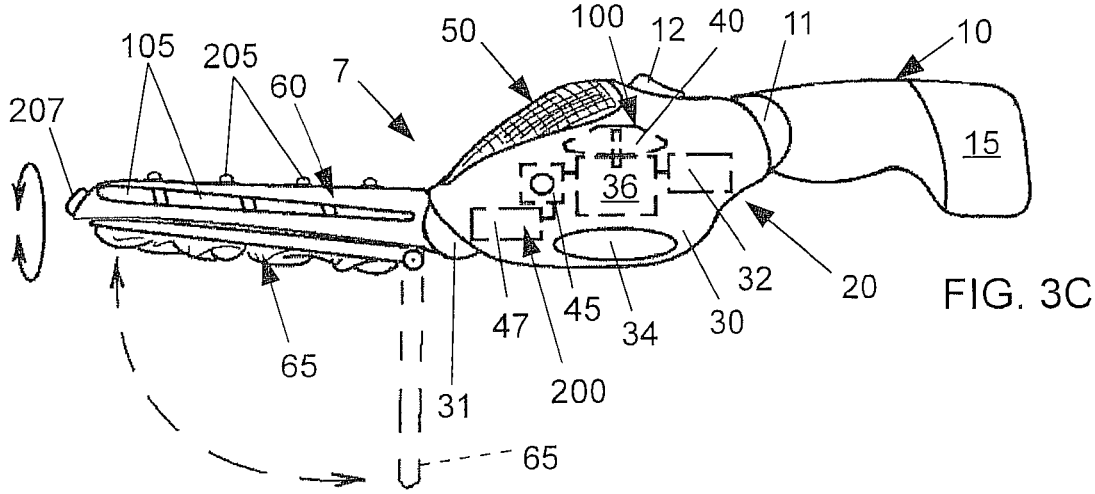
FIG. 3C is a partially schematic side elevation view of a variant of the handheld portable device of FIG. 3A with the dusting cloth assembly rotated to a downwardly facing position.

Referring now to FIGS. 3A-3C, some embodiments of device 7 incorporate at least one accessory for mechanically dislodging particulate matter from a surface being cleaned, for example, at or adjacent the nose segment 60. Nose segment 60 can include a dusting cloth assembly 65 thereupon. FIGS. 3A and 3B show a duster cloth assembly 65 that is pivotally attached an end of the nose segment that is furthest from main body segment 30. FIG. 3A shows the duster cloth assembly 65 in a folded down, stored position and FIG. 3B shows the duster cloth assembly 65 in a folded out, extended position. The duster cloth assembly 65 can be pivotally attached to other portions of device 7, as desired, e.g., handle assembly 10, main body segment 30, or others.

Referring now to FIG. 3C, in some embodiments, the duster cloth assembly 65 is pivotally attached to or near the main body segment 30. In these implementations, the duster cloth assembly 65 pivots relatively nearer to the main body segment 30 as it pivots relatively further from the nose segment 60. Optionally, the duster cloth assembly 65 can be manipulated or articulated in other ways for engaging a surface to be cleaned. As seen in FIG. 3C, the duster cloth assembly 65 can be positioned to engage or face the surface to be cleaned by rotating nose segment 60 about its longitudinal axis by way of ball joint 31, as seen in FIG. 3C.

Referring now to FIGS. 3A-4B, a dust cloth storage compartment 34 can be provided in device 7, for example, as a throughbore extending through, or an enclosure recessed into, main body segment 30. Storage compartment 34 defines an opening that is sufficiently large to allow a dust cloth to extend therethrough while remaining in place during use.

Figure 4A:
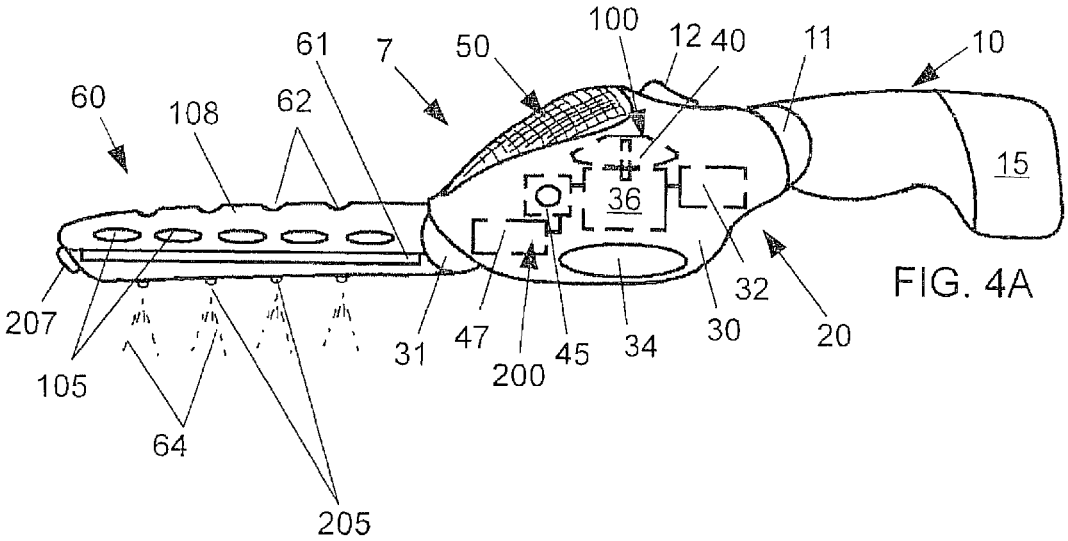
FIG. 4A is a partially schematic side elevation view of another variant of the handheld portable device of FIG. 3A.
Figure 4B:
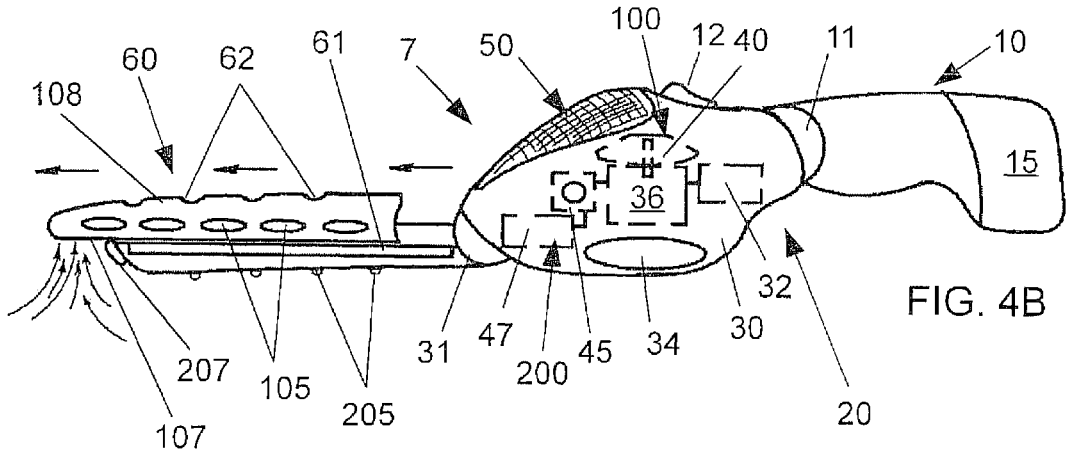
FIG. 4B is a partially schematic side elevation view of the handheld portable device of FIG. 4A with a shroud extended outwardly, exposing an auxiliary vacuum inlet.

Referring now to FIGS. 4A and 4B, yet another accessories such as squeegees 61 can be incorporated into the nose segment 60. In such embodiments, the primary vacuum inlets 105, or auxiliary vacuum inlets 107, can be located above the squeegees so that particulate matter can be pushed or swept with the squeegees 61. Squeegees 61 can any of a variety of suitable elongate members that are configured to mechanically remove or disrupt particulate matter. For example, squeegees 61 include, but are not limited to, flexible and/or foam rubber strips, non-flexible polymeric strips, durable and/or other cloths, or others. Regardless of the particular composition of squeegee 61, preferably, a leading edge of the squeegee 61 can free stuck particulate matter from a surface being cleaned, whereby it will be drawn up and across the width of the squeegee and enter device 7 through the primary or auxiliary vacuum inlet 105 or 107. Other accessories for mechanically removing or disrupting particulate matter, e.g., a brush, may also be provided.

Referring still to FIGS. 4A and 4B, in yet other embodiments, nose segment 60 includes one or more visual indicators that show a location of various components, e.g., the high pressure nozzles 205. The visual indicators can be printed indicia, or other easily seen indicators on side, upper, or other surfaces of nose segment 60. As one example, the visual indicators can be depressions 62 that extend downwardly into an upper surface of the nose segment 60. In addition to or in lieu of depressions 62, various illumination sources can emit light 64 that is usable as visual indicators of, e.g., high pressure nozzle 205 located along nose segment 60. Preferably, light emitting diodes (LEDs) are used to emit light 64 as visual indicator forms on the surface to be cleaned. Such indicators can be configured to outline the footprint of the air emitted from the nozzle on the surface.

2. Low Pressure System Generally

Referring now to FIGS. 5-9, low pressure system 100 operates as a function of the low pressure fan 40 that is preferably driven by the subassembly of motor 32 and gearbox 36. Low pressure fan 40 includes multiple rotating blades that radiate from a shaft that is preferably arranged vertically within the main body segment 30. The particular configuration of fan 40 is selected based on the intended end use implementation(s) of device 7, whereby fan 40 can be any of a variety of suitable designs such as, e.g., radial fans, axial fans, mixed flow fans, squirrel cage fans, and/or others. Preferably, fan 40 defines a flow rate of about 10-40 Cubic Feet per Minute (CFM), or preferably about 25-30 CFM, and is capable of establishing about 1-10 inches of columnar water pressure loss, or preferably about 1-3 inches of columnar water loss.

Figure 10:
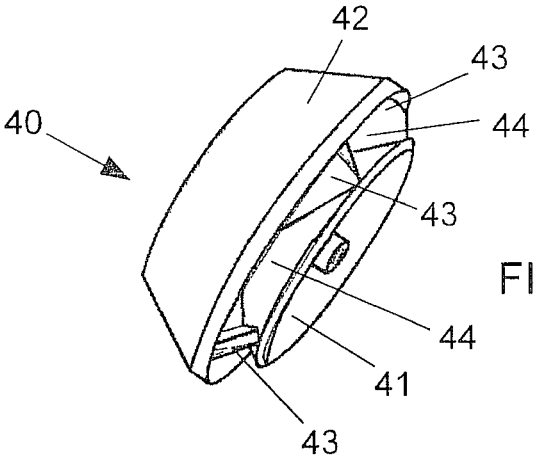
FIG. 10 is a perspective view of the low pressure fan utilized in the handheld portable device of FIG. 9.

Referring specifically to FIG. 10, fan 40 is an impeller that is preferably configured to draw in or intake air in along an axial path, yet discharge air in an airflow having both a radial and an axial component. To accomplish this mixed-flow discharge functionality, fan 40 includes a first and a second tapering members, e.g., tapered hub 41 and tapered outer shell 42 that are axially spaced from each other, noting that tapered hub 41 can extend or be nested somewhat within the tapered outer shell 42.

Still referring to FIG. 10, the tapered hub and outer shell 41 and 42 each defines an outer surface that is generally frusto-conical. Preferably, the frusto-conical outer surface of tapered hub 41 converges or tapers downwardly at a steeper or greater angle than does that of the tapered outer shell 42. In this regard, the width of the void space between the inner surface of the tapered outer shell 42 and the outer surface of hub 41 decreases while traversing from the outer shell 42 to the hub 41. Multiple fins 43 extend radially between the tapered hub and outer shell 41 and 42. The fins 43 also extend angularly with respect to an axis of rotation of the fan 40, and can, in some implementations, have one or more curves or sharp-angle bends along their respective lengths.

Still referring to FIG. 10, the rearnost portions of the tapered hub and shell 41 and 42, spaced from each other by fins 43, define openings 44 therebetween. It is through the openings 44 that the mixed-flow, e.g., combined axial and radial flow, airflow exits the fan 40.

Referring again to FIGS. 5-9, the intake side of fan 40 is utilized for providing a negative or vacuum pressure for the device 7. The intake or vacuum side of low pressure fan 40 is fluidly connected to one or more openings or primary vacuum inlets 105, optionally, also auxiliary inlet 107, provided in nose segment 60. The particular portion(s) of nose segment 60 that draw in a vacuum airflow 110 are selected based on the intended end use characteristics of device 7. Accordingly, the vacuum airflow 110 can be drawn through, e.g., a portion or the entire length of the lower portion of nose segment 60, and/or elsewhere through nose segment 60 such as one or more sidewall portions thereof.

Accordingly, the particular location(s), shape(s), and dimension(s) of the primary vacuum inlets 105 are selected based at least in part on the portion of nose segment 60 in which they are installed. For example, in typical implementations, vacuum inlets 105 are provide on a downwardly facing surface of nose segment 60 (FIGS. 5-9). The vacuum inlets 105 preferably occupy a major portion of the downwardly facing surface area, and more preferably occupy substantially all of the downwardly facing surface area. It is noted that the vacuum inlets 105 can be multiple, discrete openings in the downwardly facing surface of nose segment 60, or can be defined by a single, unitary elongate opening therethrough (FIG. 9).

Referring particularly now to FIGS. 4A and 4B, in some embodiments, the vacuum airflow 110 can be drawing through the primary vacuum inlets 105, or an auxiliary vacuum inlet 107, as desired. Vacuum inlet 107 can be covered by a shroud 108, whereby it is disengaged, in a default position such as that seen in FIG. 4A. When vacuum inlet 107 is to be utilized, the shroud 108 is slid longitudinally away from body assembly 20, exposing the vacuum inlet 107 and directing the vacuum airflow 110 therethrough.

Referring now to FIGS. 1-8, a filter assembly 50 is provided between the nose segment 60 and the inlet or vacuum side of low pressure 40. In this configuration, as low pressure fan 40 draws a vacuum airflow 110 through nose segment 60, that vacuum airflow 110 is filtered by way of filter assembly 50 before passing through the low pressure fan 40, capturing particulate matter which was removed by the device 7.

Referring still to FIGS. 1-8, preferably, the filtering material of filter assembly 50 is visually conspicuous, e.g., covered by a clear, transparent, or translucent lid or cover, enabling a user to quickly determine whether the filtering material of filter assembly 50 has been sufficiently soiled to justify replacement. Optionally, a filter fullness indicator can be provided on the device 7, visually showing a user when the filter assembly 50 or its filtering material should be replaced. The filtering material of filter assembly 50 is selected on the intended end use environment, and includes HEPA filters, matted and fiber filters, open cell foam filters other nonwoven fiber filters, corrugated filters, tacky substance covered filters, and/or others, as desired. It is further noted that the particular type and number of filtering elements and location of such elements utilized in filter assembly 50 corresponds to the intended end use of device 7. In other words, in some embodiments, filter assembly 50 is durable and washable whilst in other preferred embodiments filter assembly 50 is disposable and replaceable. Furthermore, the filter material or media of filter assembly 50 can be treated with a scent or disinfecting agent for treating, e.g., a low pressure exhaust airflow.

Figure 5:
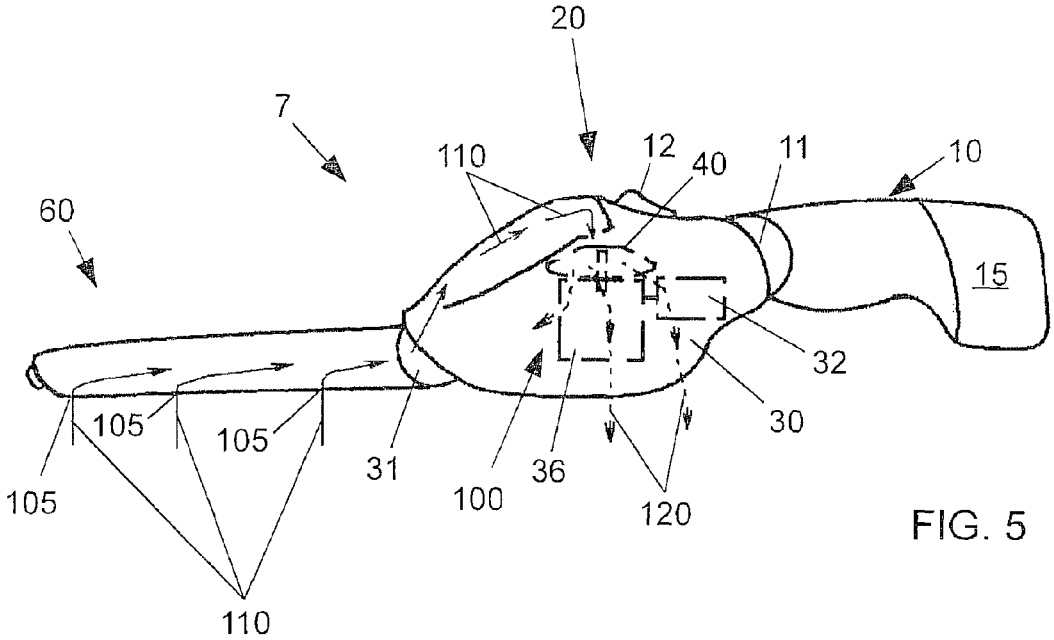
FIG. 5 is a partially schematic side elevation view of the handheld portable device of FIG. 1 showing a low pressure system airflow pattern established through the device.
Figure 6:
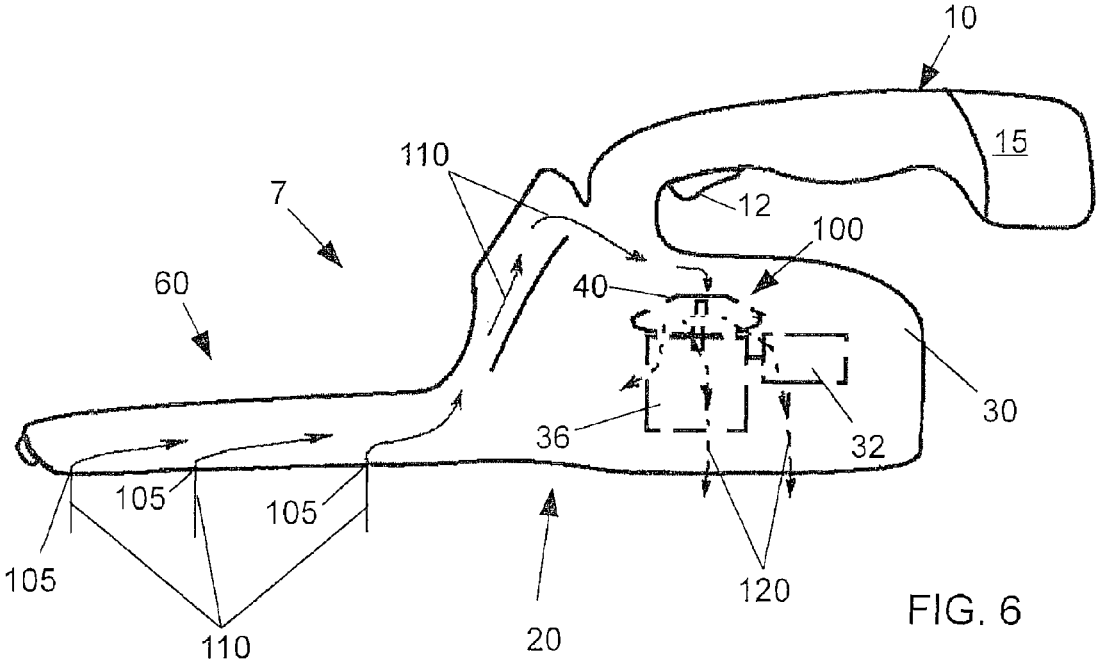
FIG. 6 is a partially schematic side elevation view of the handheld portable device of FIG. 2 showing a low pressure system airflow pattern established through the device.

Referring now to FIGS. 5-6, in some embodiments, the vacuum airflow 110 which is filtered by filter assembly 50 and enters the intake or vacuum side of low pressure fan 40, passes through the fan 40, and exits its exhaust or positive pressure side as a positive pressure, low pressure exhaust airflow 120. The low pressure exhaust airflow 120 then exits the device 7 by any of a variety of suitable venting mechanisms.

Exhaust airflow 120 can be directed out of exhaust ports or other apertures in a body assembly 20, for example, through sidewalls or other portions of main body segment 30. In other words, some embodiments of device 7 vent the filtered, positive pressure exhaust airflow 120 from low pressure fan 40 directly to the ambient. In these implementations, the exhaust airflow 120 can be treated with, e.g., a scented, odor eliminating, cleaning, or disinfecting substance as it exits the device. This allows a user to clean particulate matter from surfaces or articles while simultaneously improving any malodors nearby.

Figure 7:
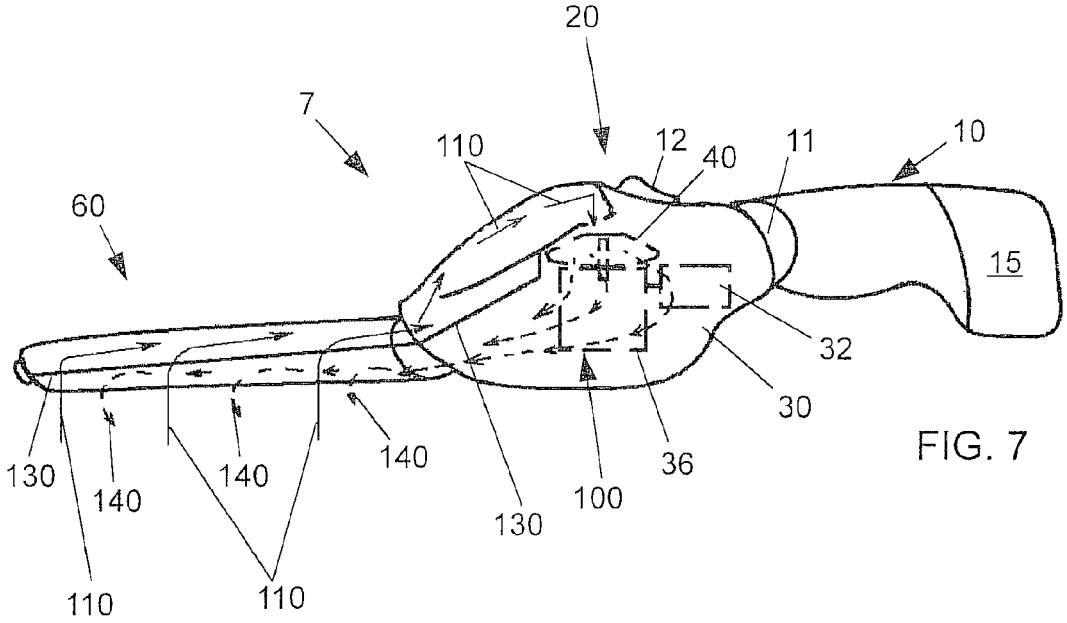
FIG. 7 is a partially schematic side elevation view of a variant of the handheld portable device of FIG. 5 showing a low pressure system airflow pattern that includes an air curtain component.
Figure 8:
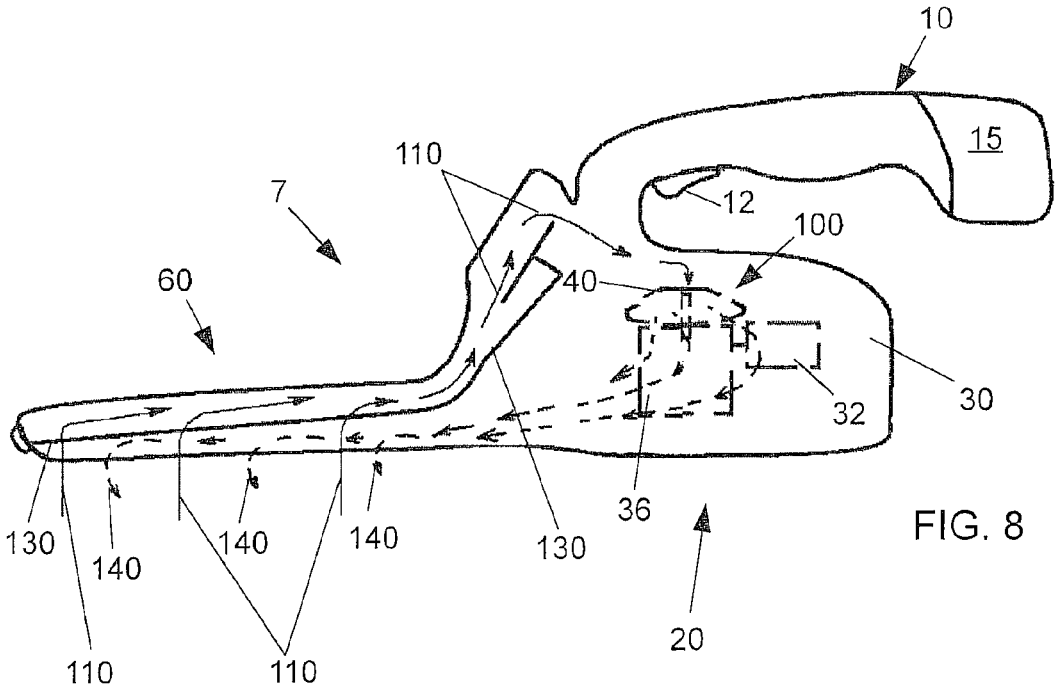
FIG. 8 is a partially schematic side elevation view of a variant of the handheld portable device of FIG. 6 showing a low pressure system airflow pattern that includes an air curtain component.
Figure 9:
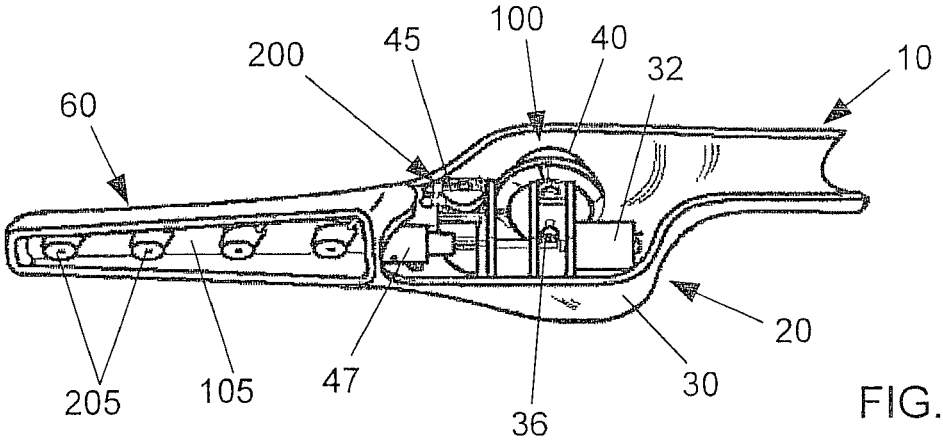
FIG. 9 is a perspective view of underside of a variant of the handheld portable device of FIG. 1, with a partial cutaway of the body and handle segments.

Referring now to FIGS. 7-8, in other embodiments, the filtered, positive pressure exhaust airflow 120 from low pressure fan 40 is directed, through suitable ducting 130, back through the nose segment 60, exiting as an air curtain type airflow 140. Preferably the vacuum airflow 110 entering the low pressure side and the exhaust airflow 120 of the positive pressure side of low pressure fan 40 traverse the nose segment 60 and other portions of device 7 as completely distinct airflow segments. Thus, ducting 130 and/or other separating structure(s) keep the vacuum and exhaust low pressure airflows 110 and 120 sealed from each other, whereby such opposing airflows only communicate with each other while entering and exiting, respectively, the nose segment 60. Stated another way, of the low pressure system 100, only the low pressure airflows outside of device 7 and adjacent the airflow affected portion of the surface being cleaned, namely, vacuum airflow 110 and air curtain 140, intimately interface and interact with each other.

Still referring to FIGS. 7-8, these exemplary embodiments allow the low pressure system 100 to establish (i) a vacuum airflow 110 that can be drawn through a medial portion of the lower surface of nose segment 60, and (ii) an air curtain 140 that can be emitted from an outer edge, sidewall, or other portion of nose segment 60 that cooperate for retaining and removing particulate matter. The air curtain 140 can be circumferentially emitted around the drawn vacuum airflow 110, whereby the air curtain can help confine and direct the vacuum airflow 110 to a particular affected zone upon the surface being cleaned. Thus, the air curtain 140 can help laterally retain any airborne particulate matter within a volume of space that the vacuum airflow 110 can act upon, facilitating drawing the particulate matter into the device 7. Furthermore, some implementations of device 7 present, e.g., a chemical cleaning agent into the air curtain 140. It is noted that since the air curtain 140 contacts the surface being cleaned, in some instances, entraining a chemical cleaning agent into air curtain 140 can supplement the high pressure system's 200 ability to dislodge particulate matter from the surface or article being cleaned.

Figure 11:
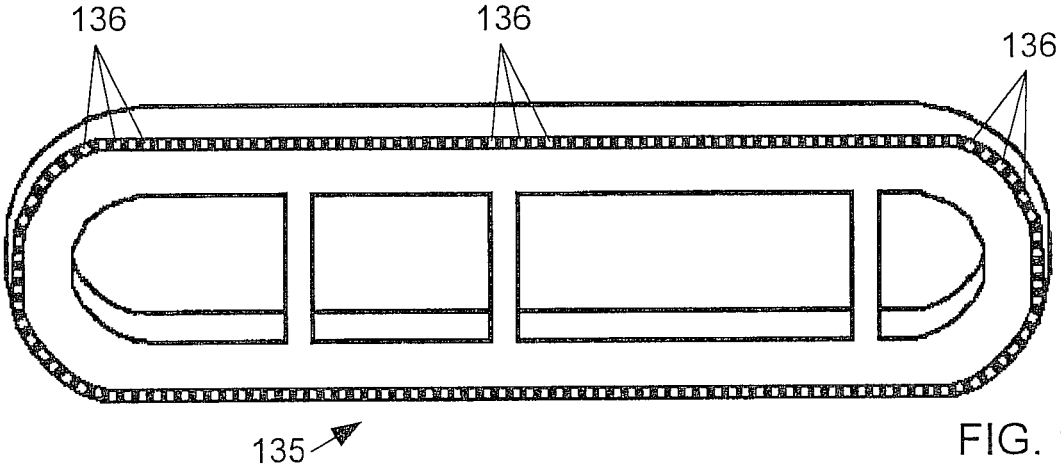
FIG. 11 is a perspective view of an embodiment of a lower flange that can be used to distribute an air curtain from a low pressure system of the present invention.
Figure 12:
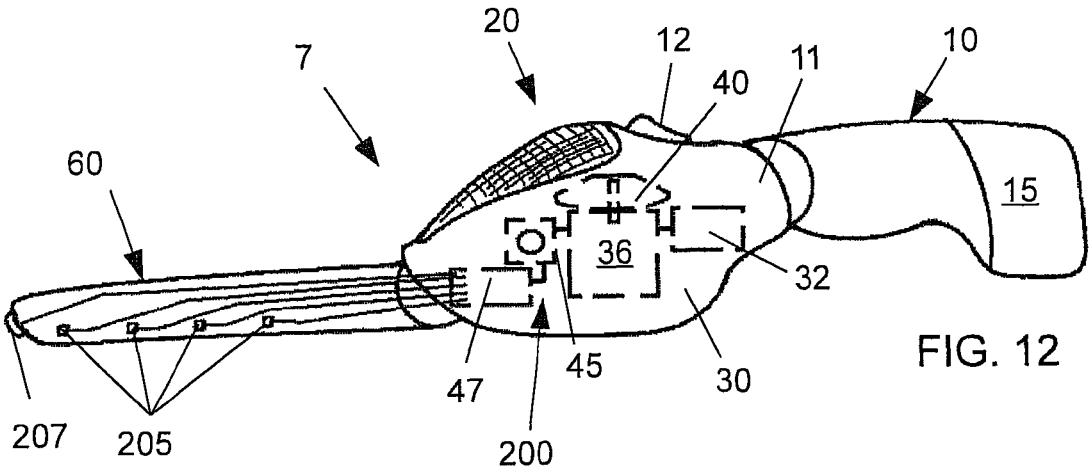
FIG. 12 is a partially schematic side elevation view of the handheld portable device of FIG. 1 showing component architecture of a high pressure system.
Figure 13:
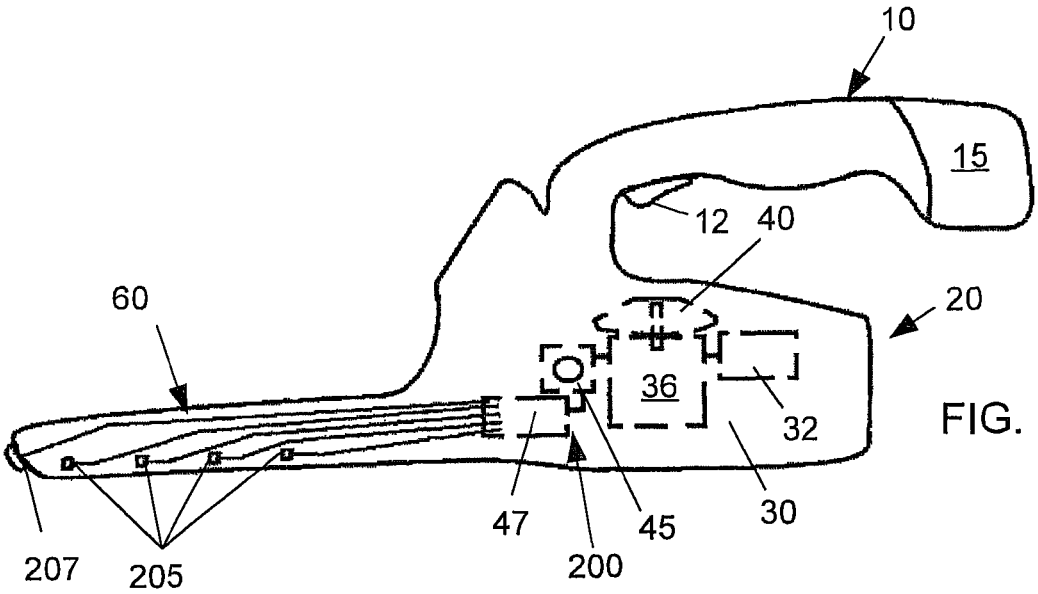
FIG. 13 is a partially schematic side elevation view of the handheld portable device of FIG. 2 showing component architecture of a high pressure system.

Referring now to FIG. 11, establishment of an air curtain 140 can be facilitated by an air curtain outlet 135 which can be, e.g., a flange attached to the bottom of nose segment 60, or an integral portion of nose segment 60. The air curtain outlet 135 can include one or more openings 136 that are configured to influence a travel path of the air curtain 140, whereby the air curtain outlet 135 contributes to and influences various performance characteristics of the air curtain 140. In some embodiments, the openings 136 of air curtain outlet 135 are provided at or adjacent its lower edge. Regardless of the particular location of the openings 136, they are fluidly connected to the output side of low pressure fan 40 so that its exhausted airflow traverses along the ducting 130 on nose segment 60 and exits the air curtain outlet 135.

The relative dimensions, sizes, shapes, or other characteristics of openings 136 substantially influence the airflow characteristics of the air curtain 140, as it exits device 7. In other words, the openings 136 are adapted and configured to provide to the airflow the desired, e.g., velocity distribution, airflow direction(s), angle of airflow exit, and/or other airflow characteristics of the airflow as it exits the device 7.

Referring still to FIG. 11, in some embodiments, the openings 136 in the middle portion of the long lateral sides of air curtain outlet 135 have relatively wider opening dimensions as compared to those near the ends of the long lateral sides. Furthermore, the openings 136 that extend about the curved ends of air curtain outlet 135 can have relatively wider opening dimensions as compared to the openings 136 in the middle of the long lateral sides thereof. The particular opening dimensions, horizontal angles of exit, vertical angles of exit, and/or other characteristics of each opening 136 is selected based at least partially on their location about the perimeter of air curtain outlet 135 and the particular desired characteristics, e.g., pressure, velocity, and/or others of the air curtain 140 which exits at that particular point.

3. High Pressure System Generally

Referring now to FIGS. 9 and 12-14, high pressure system 200 operates as a function of the high pressure compressor 45 that is preferably driven by the subassembly of motor 32 and gearbox 36. The high pressure system 200 includes high pressure compressor 45, high pressure distribution valve 47, one or more high pressure nozzles 205, and optionally an auxiliary high pressure nozzle 207.

Figure 18:
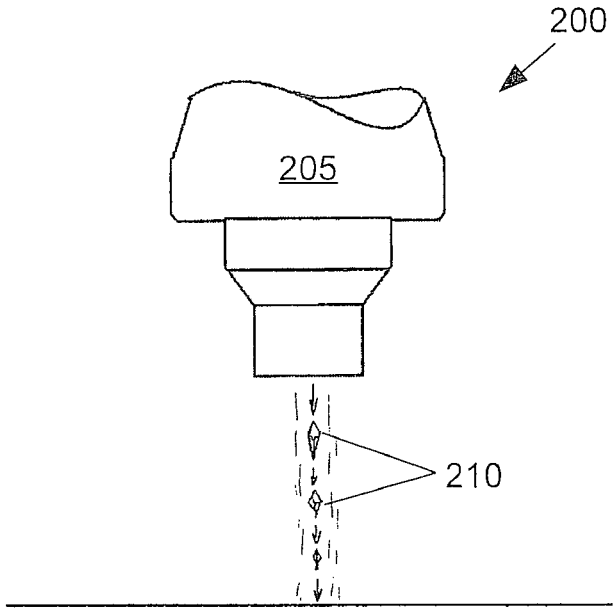
FIG. 18 is a close up front elevation of a high pressure nozzle, configured for supersonic emission, of a handheld portable device of the invention, showing a supersonic high pressure airflow burst pattern with "Mach Diamonds;"
Figure 19:
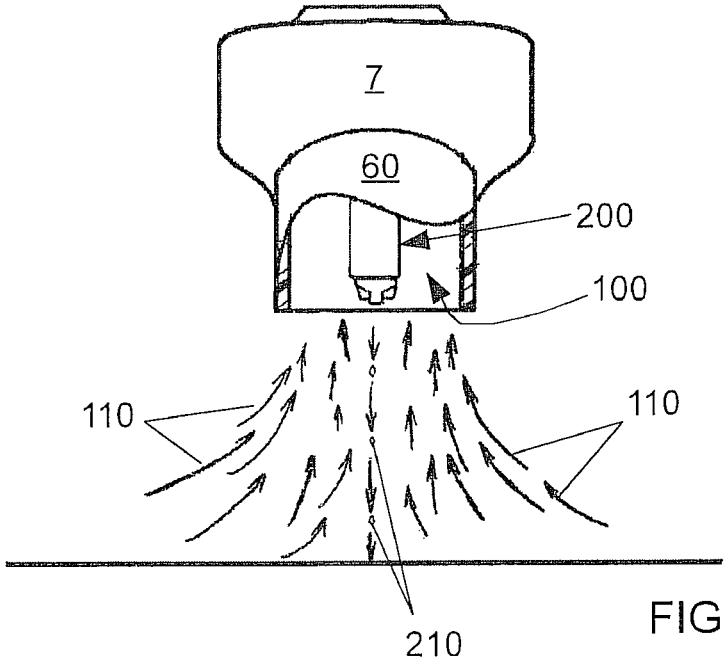
FIG. 19 is a partially cross-sectional close up end view of a handheld portable device of the invention that shows a high pressure airflow penetrating an opposing low pressure vacuum airflow.

High pressure compressor 45 is a pump to compress a charge of air which is outputted at a high pressure. Suitable pumps for creating a high pressure output include a variety of single cylinders, e.g., wobble piston, pumps, and others, as desired. Preferably, high pressure compressor 45 can operate within a pressure range of about 10-50 psi. The high pressure airflow outputted from high pressure compressor 45 is directed to the distribution valve 47. Distribution valve 47 meters and periodically releases bursts 210 of high pressure air (FIGS. 18-19), individually to the individual high pressure nozzles 205 by way of suitable tubing, air lines, or other conduits. Stated another way, the high pressure compressor 45 and distribution valve 47 cooperate with the high pressure nozzles 205 to establish and deliver bursts 210 of high pressure air to the affected zone of the surface being cleaned.

Figure 14:
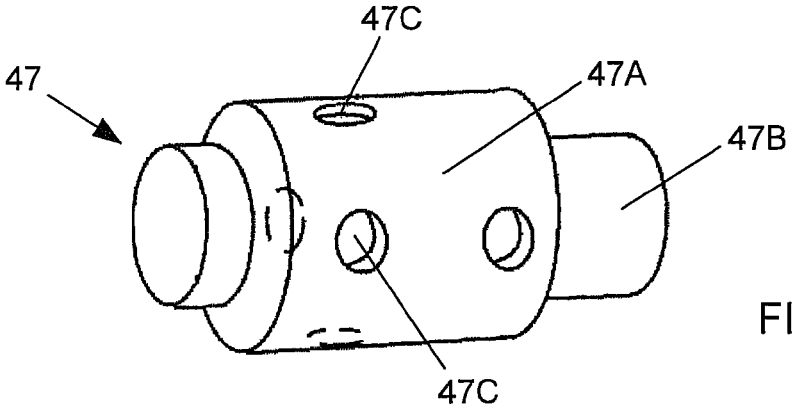
FIG. 14 is a perspective view of an embodiment of a high pressure distribution valve that can be used with a handheld portable device of the invention.

Referring now to FIG. 14, the distribution valve 47 can include a pressurized core 47A and a rotating component 47B that extends into the core 47A and is driven by gearbox 36. During use, slots in the rotating component 47B of the distribution valve 47 align with openings 47C in an outer housing the valve 47, permitting the highly pressurized air to pass therethrough, and then through fittings that are connected to tubing or air lines leading to the nozzles 205. Thus, the configuration of high pressure distribution valve 47 influences the pulse characteristics of the airflow bursts 210 that are directed to and through the nozzles 205.

Figure 15:
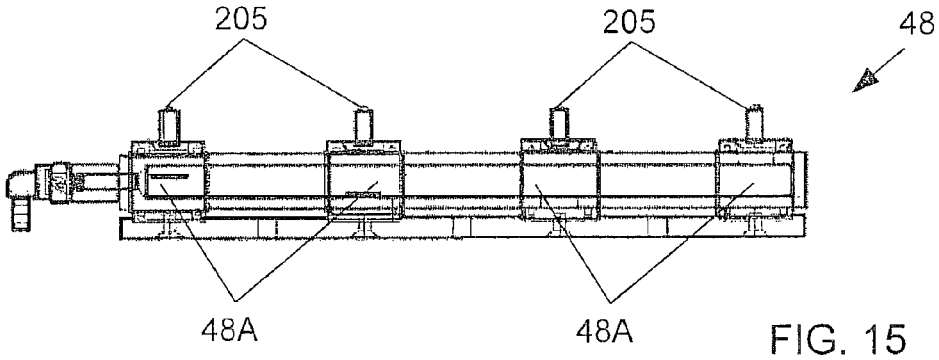
FIG. 15 is a top plan view of a common rail distribution system that can be used with a handheld portable device of the invention.
Figure 16:
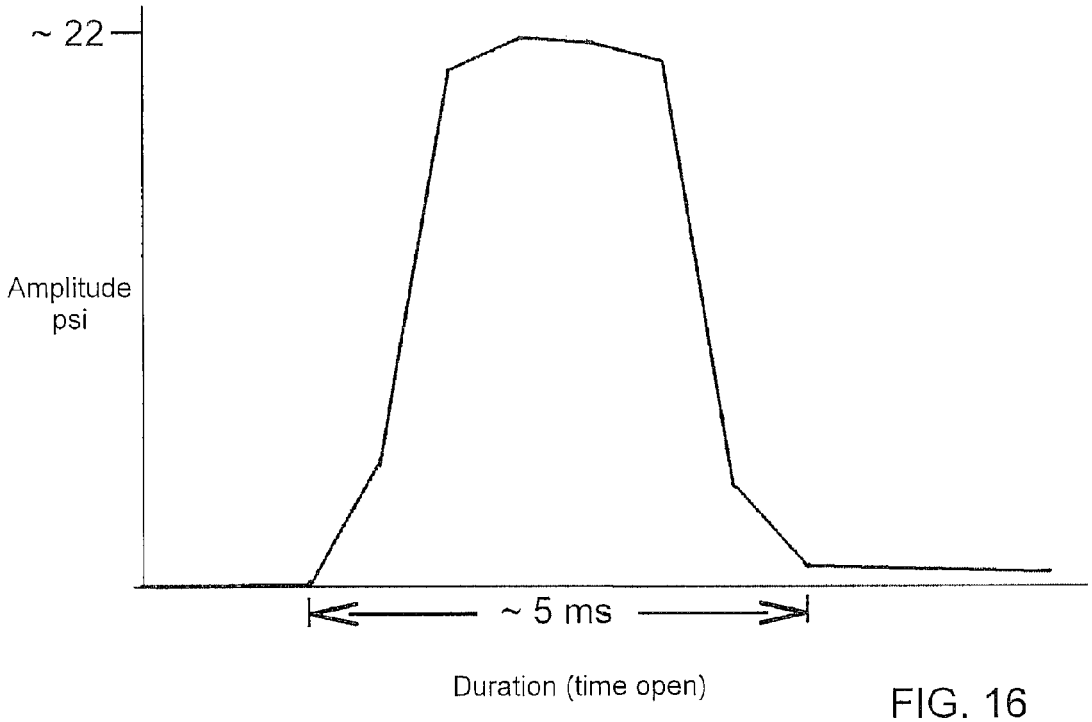
FIG. 16 is a graphical representation showing high pressure airflow pulse amplitude versus duration defined exiting a high pressure nozzle of a handheld portable device of the invention.
Figure 17:
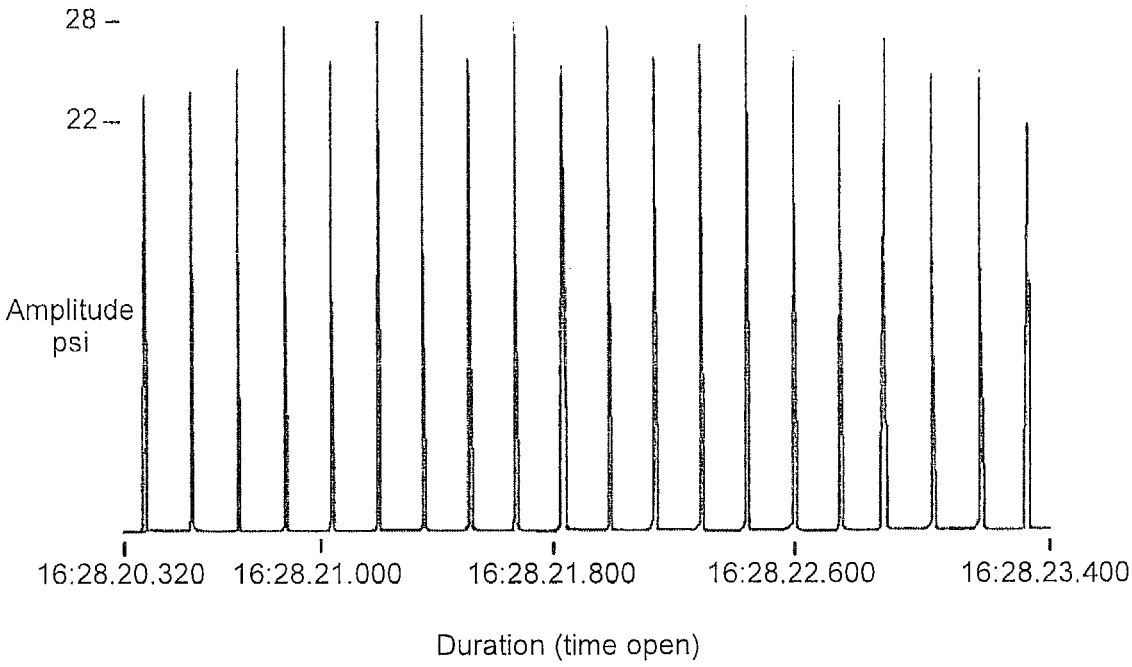
FIG. 17 is a graphical representation showing high pressure airflow pulse amplitude versus duration defined exiting a high pressure nozzle of a handheld portable device of the invention over a time period sufficient to show repeated air emission or pulse cycles that are repeated with a frequency of about 60 Hz.

Referring now to FIGS. 12-19, high pressure distribution valve 47 and nozzles 205 cooperate to release airflow bursts 210 that are very abrupt, mimicking the instantaneous delivery of fast-on and fast-off systems, while still providing sufficient flow volume of air to dislodge the particulate matter. One such suitable abrupt delivery duration and power is shown diagrammatically in FIG. 16, showing a valve 47 with a valve open-phase duration of about Sms and an amplitude of about 22 psi. FIG. 17 diagrammatically shows amplitude versus duration of airflow exiting nozzles 205 in a device 7 having a high pressure system 200 configured to discretely release high pressure airflow bursts 210 with a frequency of about 6 hz. The diagram specifically shows such results while operating four nozzles 205 at an operating pressure of about 35 psi, yielding a total air consumption of about 0.1 CFM.

Referring still to FIGS. 12-19, although distribution valve 47 is shown housed in main body segment 30, other suitable valve and airflow burst timing structures are considered and well within the scope of the invention.

For example, referring now to FIG. 15, in lieu of distribution valve 47, a common pressurized rail 48 and corresponding valve-train can be provided in nose segment 60, optionally other structures that suitably release bursts 210 having the desired duration, amplitude, and release sequence, and/or other characteristics. The common pressurized rail 48 can sequentially deliver a series of high pressure bursts through nozzles 205 by way of, e.g., mechanically actuated valves, rotary valves 48A that utilized periodic slot or aperture alignment in cooperating rotating and non-rotation components, and/or electronic solenoid valves along with known corresponding controls and related components.

Referring again to FIGS. 12-19, as compared to a continuous high pressure airflow, the sharp, discrete bursts 210 provided by high pressure distribution valve 47 (i) conserve power consumption of device 7, (ii) consume relatively less cubic feet per minute (cfm) of air, and (iii) can be more effective at dislodging stuck particulate matter, as the bursts 210 are emitted from the high pressure nozzles 205. Preferably, nozzles 205 are supersonic nozzles, whereby they are configured to accelerate the bursts 210 of airflow to supersonic velocities. As the airflow bursts 210 achieve supersonic velocities, they exhibit "Mach Diamond" profile characteristics, which can be seen particularly well in FIGS. 18-19.

Referring still to FIGS. 12-19, nozzles 205 can be configured to impart various other characteristics to the airflow bursts 210. For example, the openings of nozzles 205 can be oval or other shaped to influence the surface area and shape upon the surface being cleaned and affected by the airflow bursts 210. Correspondingly, the particular number of nozzles 205, the spacing between them, and their respective orientation and/or arrangements within the nose segment 60, are all selected to provide desired, e.g., impact angles and/or other characteristics of airflow bursts 210.

Accordingly, the opening perimeter shapes of nozzles 205 and the profile and inside diameter(s) of the axial bores extending therethrough at least partially define blast radii or blast diameters upon the surface being cleaned. The spacing and particular emission sequence and arrangement of the nozzles 205 are configured to provide the desired cumulative blast pattern and corresponding coverage area on the surface being cleaned, be it linear, curvilinear, overlapping, spaced, or otherwise.

C. System Use

Referring again to FIGS. 1-9 and 12-13, in light of the above, to use the device 7, the user first removes the device 7 from the charging station 9, then adjusts the position of handle assembly 10 and/or nose segment 60, if equipped with ball joints 11 and 31. Next, the user positions the nose segment 60 of device 7 over the surface or article which has accumulated particulate matter.

Preferably, the nose segment 60 is positioned between about 0.5 to 4 inches, optionally about 1 to 3 inches, or preferably about 1 inch, above such surface or article, but regardless, the user need not touch or otherwise contact the device 7 to it. Then, the user actuates the switch 12 and thereby energizes motor 32 which, by way of gearbox 36, low pressure fan 40 and high pressure compressor 45, powers the low and high pressure systems 100 and 200. The user is then able to detach and capture or remove dust or other particulate matter in a touchless manner, even from under overhanging structures of objects without having to remove the objects from their resting places to access the under sides of the overhanging structures.

Upon so doing, the device 7 establishes a low pressure vacuum airflow 110 and high pressure airflow bursts 210. Since the high pressure nozzles 205 are positioned, for example, centrally and linearly, within nose segment 60, the high pressure airflow bursts 210 penetrate through or adjacent the vacuum airflow 110. In this regard, the high pressure airflow bursts 210 can dislodge at least some of the particulate matter from the surface that is being cleaned, and the vacuum airflow 110 removes the particulate matter and captures it in the filter assembly 50. This allows the particulate matter is removed from the surface or article by way of a touchless technique.

In some implementations, an optional low pressure air curtain output airflow concentrically surrounds the vacuum airflow and defines an outermost disposed airflow for containing the dislodged dust and debris within its perimeter. Regardless, the device 7 removes dust or debris from a surface or object without ever having touched, contacted, or moved such surface or object, relatively reducing the time required for a user to perform various household dust or debris removing tasks. However, some embodiments include at least one accessory for mechanically dislodging particulate matter from a surface being cleaned so that if desired, a user can also use contact-type cleaning techniques in addition to the touchless techniques allowed by the device 7.

Figure 20:
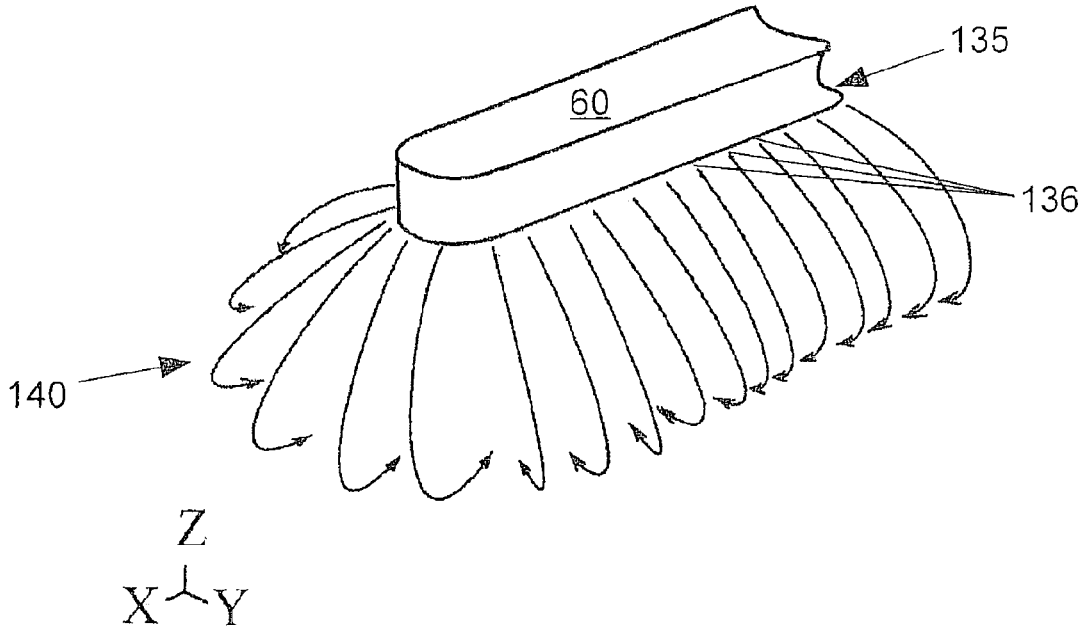
FIG. 20 is a perspective view of nose segment, showing an airflow pattern of an air curtain that can be used with a handheld portable device of the present invention.
Figure 21:
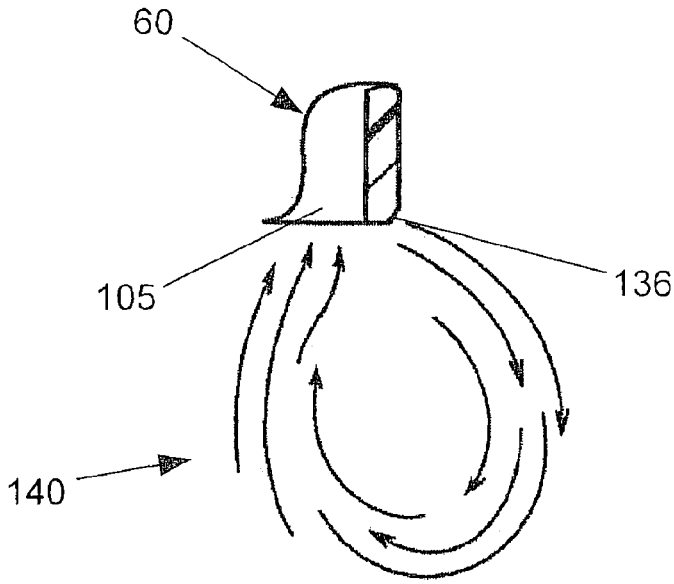
FIG. 21 is a cross-sectional end view of a portion of a nose segment, showing an airflow pattern of an air curtain that can be used with a handheld portable device of the present invention.

Referring now to FIGS. 20 and 21, the overall performance characteristics of air curtain outlet 135 can be tuned or determined by, e.g., configuring each opening 136 so that the air curtain exits the nose segment 60 at about a 45 degree, optionally about a 30 to 55 degree, optionally about a 25 to 60 degree, angle toward the surface being cleaned, then tightly curls inwardly toward the vacuum inlet 105. In this configuration, the nose segment 60 emits an inwardly rolling air curtain 140 that flows first concentrically outward and downward, and then changes direction at or near the surface being.

While changing direction, the airflow curls inwardly and upwardly toward the nose segment 60 so that the air curtain 140 and vacuum airflow 110 generally interface intimately with each other. Accordingly, the low pressure airflows of the device 7 can be rather tightly defined or restrained adjacent the perimeter of the nose segment 60, whereby the optional outputted air curtain 140 can be quickly involuted back into the nose segment 60, and preferably within a distance of less than about 4 inches, optionally less than about 5 inches, optionally less than about 6 inches, from its point of exit from the nose segment 60. This contributes a low pressure airflow pattern with opposing angulary expanding and involuting airflow segments, e.g., air curtain 140 and vacuum airflow 110.

It is noted that for embodiment that incorporate an air curtain 140, if the device 7 is held in a constant position for an extended period of time, the low pressure airflow could become at least partially a recirculating volume of air, flowing from, e.g., the output side of low pressure fan 40 nose segment 60, exiting through outlet 135 and openings 136. The volume of air would then curl back inwardly toward and enter the nose segment 60 through the vacuum inlet 105, then through the remainder of nose segment 60, through filter assembly 50, and then be drawn into the intake side of low pressure fan 40.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept. Further, when the device 7 is used on relatively low-lying surfaces, e.g., floors and others, it may further include wheels or be adapted to slide, and also have an elongate handle allowing a user to stand upright while removing particulate matter from such low-lying surfaces.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. A handheld portable device for dislodging and capturing particulate matter from a surface to be cleaned, the handheld portable device comprising:

a handle that extends in a first direction and is provided at a first end of the handheld portable device and that can be grasped by a user so that the user supports the entire handheld portable device by the handle;

a nose segment that has a width and a length that is greater than the width so that the nose segment has an elongate arrangement within the handheld portable device, the nose segment extending in a second, generally opposite direction away from the handle so that the nose segment and handle are generally parallel and offset from each other, the nose segment being provided at a second, opposing end of the handheld portable device, wherein the nose segment is interconnected with the handle such that the nose segment and handle move in unison with each other while the entire handheld portable device is being supported by the user;

a body segment disposed between the handle and the nose segment;

at least one articulating connecting element, comprising a ball joint, coupled between the body segment and the handle configured to enable articulating movement of the handle relative to the body segment;

a vacuum airflow entering the nose segment and defining a vacuum affected zone on and adjacent the surface to be cleaned; and at least one high pressure nozzle provided at the nose segment and delivering a high pressure airflow, so that the high pressure airflow exits the nose segment and contacts the surface to be cleaned, wherein the high pressure airflow dislodges at least some of the particulate matter from the surface to be cleaned for capture by the vacuum airflow so that particulate matter is removed from the surface to be cleaned while the handheld portable device is being supported by the handle.

2. The handheld portable device of claim 1, further comprising at least one additional articulating connecting element coupled between the body segment and the nose segment for articulating movement of the nose segment relative to the body segment.

3. The handheld portable device of claim 2, further comprising a valve that periodically releases bursts of high pressure air so that the high pressure airflow is emitted as a series of discrete pulses.

4. The handheld portable device of claim 3, wherein the valve is a rotary valve that includes (i) multiple openings that are fluidly connected to respective multiple high pressure nozzles, and (ii) a rotating component that rotates to periodically permit the high pressure airflow to be directed through the multiple high pressure nozzles such that discrete pulses are emitted from the multiple high pressure nozzles during rotation of the rotating component.

5. The handheld portable device of claim 4, wherein the multiple high pressure nozzles are spaced from each other along a length dimension of the nose segment.

6. The handheld portable device of claim 1, wherein the handheld portable device weighs less than about 2 pounds and wherein each of (i) a fan that establishes the low pressure airflow, and (ii) a compressor that establishes the high pressure airflow, is provided inside of the handheld portable device between the handle and nose segments.

7. A handheld portable device for dislodging and capturing particulate matter from a surface to be cleaned, the handheld portable device comprising:

a handle that is provided at a first end of the handheld portable device and that can be grasped by a user so that the user supports the entire handheld device by the handle defining a handle height, length, and width;

a nose segment that is elongate and is generally parallel and offset with and extends away from the handle and being provided at a second end of the handheld portable device defining a nose segment height, length, and width that are parallel with the handle height, length, and width, wherein at least one of the nose segment height and width is less than the corresponding handle height and width;

a main body segment that interconnects the handle and nose segment;

an articulating ball joint interconnecting the main body segment with the handle and configured to enable articulating movement of the handle relative to the main body segment;

a primary vacuum inlet port provided in the nose segment;

a low pressure system provided between the first and second ends of the handheld portable device and that can create a low pressure vacuum airflow that is drawn through the primary vacuum inlet port;

a high pressure nozzle provided in the nose segment; and a high pressure system provided between the first and second ends of the handheld portable device that can create a high pressure airflow that is emitted out of the high pressure nozzle, wherein the high pressure nozzle and the primary vacuum inlet port respectively emit and draw in the opposing (i) high pressure emitted, and (ii) low pressure vacuum airflows such that the high pressure emitted airflow dislodges at least some of the particulate matter from the surface to be cleaned and the low pressure vacuum airflow captures at least some of the dislodged particulate matter, so that particulate matter is removed from the surface to be cleaned while the handheld portable device is being supported by the handle and the nose segment is spaced from the surface being cleaned.

8. The handheld portable device of claim 7, further comprising multiple high pressure nozzles and a valve that has multiple outlets that can open and close at different times, the multiple outlets of the valve being connected to the multiple high pressure nozzles so that the valve periodically releases bursts of high pressure air through the multiple high pressure nozzles, whereby the high pressure airflow is emitted as a series of discrete pulses.

9. The handheld portable device of claim 7, wherein the low and high pressure systems are housed within the main body segment.

10. The handheld portable device of claim 9, the low pressure system further comprising a fan that generates the low pressure vacuum airflow and a compressor that generates the high pressure airflow.

11. The handheld portable device of claim 10, further comprising a filter assembly that is housed in the main body segment, the filter assembly being provided between the fan and the nose segment so that the low pressure vacuum airflow that is drawn through the primary vacuum inlet port is directed through the filter assembly before flowing through the fan.

12. The handheld portable device of claim 10, further comprising a motor and a gearbox that interconnects the motor with the fan and the compressor so that the motor drives both of the fan and the compressor.

13. The handheld portable device of claim 7, wherein the nose segment is tapered.

14. The handheld portable device of claim 7, wherein the height and width of the nose segment are less than three inches.

15. The handheld portable device of claim 7, wherein the height and width of the nose segment are less than two inches.

16. The handheld portable device of claim 7, wherein the nose segment comprises an auxiliary vacuum inlet and an auxiliary high pressure nozzle displaced from the primary vacuum inlet port and high pressure nozzle.

* * * * *